US008425697B2

(12) United States Patent
Xu et al.

(10) Patent No.: US 8,425,697 B2
(45) Date of Patent: Apr. 23, 2013

(54) TIN-FREE LEAD-FREE FREE-CUTTING MAGNESIUM BRASS ALLOY

(75) Inventors: Chuankai Xu, Xiamen (CN); Zhenqing Hu, Xiamen (CN); Siqi Zhang, Changsha (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 12/631,603

(22) Filed: Dec. 4, 2009

(65) Prior Publication Data

US 2010/0080731 A1 Apr. 1, 2010

Related U.S. Application Data

(63) Continuation of application No. 12/354,510, filed on Jan. 15, 2009, now abandoned, which is a continuation-in-part of application No. 12/208,043, filed on Sep. 10, 2008, now abandoned, which is a continuation-in-part of application No. 12/207,136, filed on Sep. 9, 2008, now abandoned.

(30) Foreign Application Priority Data

Jun. 11, 2008 (CN) ..... 2008 1 0110818

(51) Int. Cl.
*C22C 9/04* (2006.01)

(52) U.S. Cl.
USPC ..... 148/434; 420/477; 420/478; 420/479; 420/480; 420/481; 420/482; 420/483; 420/484

(58) Field of Classification Search ..... 148/434; 420/477–484
See application file for complete search history.

(56) References Cited

U.S. PATENT DOCUMENTS

2007/0243096 A1* 10/2007 Kurose et al. ..... 420/476

FOREIGN PATENT DOCUMENTS

| | | |
|---|---|---|
| JP | 11293366 | * 10/1999 |
| JP | 2002038246 | * 2/2002 |
| JP | 2004285449 | * 10/2004 |

* cited by examiner

*Primary Examiner* — Sikyin Ip
(74) *Attorney, Agent, or Firm* — McDermott Will & Emery LLP

(57) ABSTRACT

A tin-free lead-free free-cutting magnesium brass alloy contains 56.0 to 64.0 wt % Cu, 1.05 to about 2.1 wt % Mg, 0.21 to 0.4 wt % P and other elements 0.002 to 0.9 wt % which contain at least two elements selected from Al, Si, Sb, rare earth elements, Ti and B and the balance being Zn with unavoidable impurities, accordingly a cutting percentage of the alloy is at least 80%. The process for producing such alloy is also proposed. The invented alloy is excellent in cuttability, castability, hot and cold workability, corrosion resistance, mechanical properties and weldability and particularly applicable in spare parts, forging and casting which need cutting and grinding process. The cost of necessary metal materials of the invented alloy is lower than lead-free free-cutting bismuth and antimony brass alloy and is equivalent to lead-contained brass alloy.

13 Claims, 4 Drawing Sheets

TIN-FREE LEAD-FREE FREE-CUTTING MAGNESIUM BRASS ALLOY

CROSS REFERENCE TO RELATED APPLICATIONS

This application is a continuation of U.S. patent application Ser. No. 12/354,510 filed on Jan. 15, 2009, now abandoned, which is a continuation-in-part of Ser. No. 12/208,043 filed on Sep. 10, 2008, now abandoned, which is a continuation-in-part of U.S. patent application Ser. No. 12/207,136 filed Sep. 9, 2008, now abandoned, which claims priority from Chinese Patent Application No. 200810110818.3 filed Jun. 11, 2008.

FIELD OF THE INVENTION

The present invention generally relates to a magnesium brass alloy, especially a tin-free lead-free free-cutting magnesium brass alloy which is applicable in spare parts for a water supply system.

BACKGROUND OF THE INVENTION

It is well-known that lead-containing brass alloys such as CuZn40Pb1, C36000, C3604 and C3771 usually contain 1.0-3.7 wt % Pb for ensuring excellent free-cuttability.

Lead-containing brass alloys are still widely used in the manufacture of many products due to their excellent cuttability and low cost. However, Pb-contaminated steam produced by the process of smelting and casting lead-contained brass alloy and Pb-contaminated dust produced in the process of cutting and grinding the lead-contained brass alloy are harmful to the human body and the environment. If the lead-containing brass alloys are used in drinking-water installations such as faucets, valves and bushings, contamination of the drinking water by Pb is unavoidable. In addition, toys which are produced by Pb-containing brass alloys are more harmful, as they are touched frequently, thus increasing potential exposure to Pb.

Ingestion of lead by humans is harmful, so the use of lead is being strictly banned by law in many countries due to the concerns on health and environment. For dealing with this challenge, metallurgists and manufacturers of copper materials actively research and develop lead-free free-cutting brass alloys.

For example, Hofmann et al. in US20040241038 disclose a lead-free copper alloy composition. However, US20040241038 teaches away from adding more than 0.2 wt % P, stating that "above 0.2% [of P], however, the disadvantages would be predominant." US20040141038 para. [0037]. US20040241038 also does not disclose an alloy containing less than 0.5 wt % Sn. The alloy disclosed in US20040241038 also requires the expensive element Ni.

In the different and unrelated context of providing an alloy for electric connectors, JP 2002038246 discloses a so-called Colson alloy that may be lead free. JP2002038246 does not teach an alloy containing relatively high levels of P and Mg. A so-called Colson alloy is a Cu—Ni—Si based alloy. Therefore, the alloy of JP2002038246 requires the expensive element Ni. JP2002038246 does not teach a tin-free alloy. JP2002038246 does not address the alloy's cuttability or machinability.

Some lead-free free-cutting brass alloys use Si instead of Pb, but the cuttability is not remarkably improved and the cost increases due to the high quantity of copper. Therefore, silicon brass alloys are not commercially competitive at present.

One commonly used type of lead-free free-cutting brass alloy is a bismuth brass alloy, which uses bismuth instead of Pb. Many kinds of bismuth brass alloys with high or low zinc have been developed and their formal alloy grades have been registered in the United States. These kinds of brass alloy contain valuable tin, nickel and selenium as well as bismuth. For example, Kurose et al. in US 20070243096 discloses such an alloy. Although their cuttability is 85%-97% of lead-contained brass alloy C36000, their cost is far higher than lead-contained brass alloy C36000. Therefore, these kinds of bismuth brass alloys are not competitively priced. Bismuth brass alloys also have been researched and developed in Japan and China and filed in their Patent Office. Considering that bismuth element is expensive, rare in the reserves and has poor cold and hot workability, using a bismuth brass alloy instead of a lead-containing brass alloy may be financially problematic. The invention of a free-cutting antimony brass alloy which use Sb instead of Pb has been patented in China (ZL200410015836.5). A corresponding U.S. application (US2006/0289094) is currently pending. There is, therefore, a need for a lead-free, tin-free, bismuth-free free cutting brass alloy that has excellent integrated performance at a reduced cost.

DETAILED DESCRIPTION

One object of the present invention is to provide a magnesium brass alloy which will solve the limitations of conventional brass alloy discussed above especially the problem of lead contamination.

One object of the present invention is to provide a lead-free tin-free magnesium brass alloy which is excellent in cuttability, castability, hot and cold workability and corrosion resistance and not harmful for the environment and the human body.

One object of the present invention is to provide a lead-free tin-free free-cutting magnesium brass alloy which is particularly applicable in spare parts for water supply systems.

One object of the present invention is to provide a manufacturing method for a magnesium brass alloy.

The objects of the present invention are achieved as follows.

The present invention is intended to provide a lead-free tin-free free-cutting magnesium brass alloy which comprises: 56.0 to 64.0 wt % Cu, 1.05 to about 2.1 wt % Mg, or as high as 2.5 wt % Mg, 0.21 to 0.4 wt % P, other elements 0.002 to 0.9 wt %, (the said other elements comprise at least two elements selected from Al, Si, Sb, rare earth elements (RE), Ti and B and the balance being Zn with unavoidable impurities.

The invented alloy is in the base of alpha-beta brass and realizes excellent cuttability by the fracture of intermetallic compounds $Cu_2Mg$ which is formed from element Mg and Cu.

In the present invention, P is an important element. It improves castability, weldability, dezincification, and corrosion resistance of the invented alloy. The intermetallic compounds $Cu_3P$ which is formed from element P and Cu is complementary for the cuttability of the invented alloy. If the content of P is lower than 0.2 wt %, its benefit for cuttability of the magnesium brass alloy is not apparent. Therefore, the addition of P is preferably set in the range of 0.21 to 0.3 wt %, more preferably in the range of 0.21 to 0.29 wt % and most preferably in the range of 0.26 to 0.28 wt %.

The invented alloy presents multi-component alloying and grain refining which favors the intermetallic compounds $Cu_2Mg$ and $Cu_3P$ in granular form to uniformly disperse in the interior and boundary of the crystal grain and improves plasticity of the alloy.

Mg is one of the main elements of the invented alloy aside from Zn. At 722° C., the solid solubility of Mg in the matrix of copper is 3.3 wt %. The solid solubility of Mg in the matrix of copper will be decreased rapidly with the temperature decrease. The solid solubility will be equivalent to zero when the temperature is equivalent to the room temperature, precipitated Mg with Cu will form brittle but not hard intermetallic compounds $Cu_2Mg$. Considering this characteristic of Mg, Mg is selected as one of the main elements of the invented alloy for ensuring the cuttability of the invented alloy. Mg also has the effect of deoxidization, grain refining and dezincification corrosion resistance. However, with the increasing of Mg addition, the effects of dezincification corrosion resistance and castability will decrease. Therefore, the Mg content of the alloy is an important aspect of the invention. If the content of Mg drops below 1.05 wt %, the desirable effects will be less apparent. If the content of Mg exceeds 2.5 wt %, the effect of oxidization resistance of the invented alloy will decrease and the face of the ingot or castings will have a darker appearance. The addition of Mg is preferably set in the range of 1.05 to 2.0 wt % and more preferably in the range of 1.05 to 1.6 wt %.

The conventional brass alloy in the prior art usually contains a small amount of Mg (less than 0.01 wt %) for deoxidization and grain refining, and a small amount of P (among 0.003 to 0.006 wt %) for deoxidization and for improving weldability of the brass alloy. As discussed above, the prior art teaches away from adding more than 0.2 wt % P. The prior art does not disclose that adding Mg improves the machinability of an alloy. The prior art also does not disclose adding a combination of P and Mg to improve machinability and cutting performance. In the present invention, the content of Mg and P is much higher than the prior art discussed above. The higher levels of Mg and P are important to the unexpected properties that are possessed by the invented alloy, including improved castability, cuttability, corrosion resistance, grain refining and mechanical properties, amongst others. The invented alloy has excellent integrated performance. The invented alloy is a type of new lead-free magnesium brass alloy with high levels of P and Mg.

Among other elements, Sb is a beneficial element for improving dezincification corrosion resistance. When Mg and P are contained in the invented alloy, the content of Sb is preferably set in the range of 0 to 0.25 wt %. Al and Si have the effects of deoxidization, solid solution strengthening and corrosion resistance. If the content of Al and Si is higher, the flowability of the alloy melt will decrease. If the content of Si is higher, hard and brittle γ-phase will form from Si and Cu so that the plasticity of the alloy melt will decrease. Preferably the addition of Al and Si is separately set in the range of 0.1 to 0.4 wt %. Rare earth elements (RE), Ti and B are very effective in grain refinement. Most kinds of lead-free free-cutting brass alloy more or less comprise these elements. The invented alloy also contains one or two such elements for grain refinement. Rare earth elements (RE) also could ease the intermetallic compounds to disperse in the boundary of crystal grain and partially transfer to the interior of crystal grain.

Prior art alloys included the elements Sn and Ni to improve corrosion resistance, amongst other reasons. However, the alloy of the present invention need not include Sn or Ni. This is an improvement over the prior art because it further reduces the cost of the alloy without affecting its desirable properties.

Fe also could refine the crystal grains for brass alloy, but Fe without solution or precipitated Fe as temperature decreases will influence the corrosion resistance of the alloy and consume P which is an important element for the invented alloy. The amount of Fe as an unavoidable impurity in the invented alloy, is less than 0.05 wt %. The amount of Pb as an unavoidable impurity in the invented alloy, is less than 0.02 wt %.

The cost of necessary metal materials of the invented alloy is lower than lead-free free-cutting bismuth brass alloy and antimony brass alloy and is equal to lead-contained brass alloy by election of alloy elements and design of element content.

The manufacturing processing of the invented alloy is as follows:

The raw materials used in the alloy in accordance with the invention include: electrolytic Cu, electrolytic Zn, brass scrap, magnesium alloy, Cu—P master alloy, Cu—Si master alloy, Cu—Ti master alloy, Cu—B master alloy, and optionally industrially pure Sb, Al, and Rare earth elements (RE). The raw materials are added in a non-vacuum intermediate frequency induction electric furnace with a quartz sand furnace lining, in the following order:

First, electrolytic Cu, brass scraps, and covering agent that enhances slag removal efficiency are added to the furnace. These materials are heated until they have melted. Then the Cu—Si master alloy, Cu—Ti master alloy, and Cu—B master alloy are added to the melt. Thereafter, pure Sb, Al and Rare earth elements (RE) may optionally be added. These materials are again heated until melted, and are thereafter stirred. Then electrolytic Zn is added to the melt. The melt is stirred, and slag is skimmed from the melt. The Cu—P master alloy is then added, and the melt is stirred further. At last the magnesium alloy is added, and the melt is stirred further. When the melt reaches a temperature of 995 to 1030 degrees Celsius, it is poured into ingot molds.

The alloy ingots may be processed in different ways according to the method of the invention. First, the ingot may be extruded at a temperature between 550 to 720 degrees Celsius for about 1 hour with an elongation coefficient of greater than 30 to be formed, for example, into bar materials. Second, the ingot may be forged at a temperature between 580 and 680 degrees Celsius to be formed, for example, into a valve body for manufacturing water supply system components. Third, the ingot may be remelted and cast at a temperature between 995 to 1015 degrees Celsius at a pressure of 0.3 to 0.5 Mpa for manufacturing faucets.

The advantages of the invented alloy are as follows. Smelting is processing in the atmosphere when the metals are protected with the covering agent. The addition of easily oxidized and volatile Mg is not effected by the addition of a conventional Cu—Mg master alloy or pure magnesium, but rather by Mg-based alloy whose melting point is lower than pure magnesium and boiling point is higher than pure magnesium. This reduces the consumption of Mg and is better to control the addition of Mg. Casting ingots rather than extruding bars are used to disposably form spare parts with complex structures for water supply systems by precision die forging. It could take out extruding process and save manufacturing cost. By die forging and extruding with an elongation coefficient greater than 30, the intermetallic compounds $Cu_2Mg$ and grain are further refined and dispersed uniformly thereby improving the mechanical properties of the invented alloy. The manufacturing method of the invented alloy is easy to carry out. And the equipments for production are the same as Pb-contained brass alloy.

BRIEF DESCRIPTION OF THE DRAWINGS

To understand the present invention, it will now be described by way of example, with reference to the accompanying drawings in which.

EXAMPLES

The alloy composition in examples is shown in Table 1. The alloy ingot is extruded at the temperature ranging from 580° C. to 700° C. with an elongation coefficient of greater than 30 into bar materials. Some alloy ingot is forged at the temperature ranging from 590° C. to 710° C. to be spare parts with a complex structure for a water supply system. Some alloy ingot is remelted at the temperature between 990 to 1015° C. to make faucets by low pressure die casting.

TABLE 1

Composition of lead-free free-cutting magnesium brass alloy (wt %)\

| Examples | Cu | Mg | P | Sb | Si | Al | Ti | B | RE | Zn |
|---|---|---|---|---|---|---|---|---|---|---|
| 1 | 62.38 | 1.16 | 0.36 | 0.05 | — | 0.20 | 0.04 | | — | Balance |
| 2 | 61.95 | 1.13 | 0.33 | — | — | 0.21 | 0.03 | — | — | Balance |
| 3 | 62.14 | 1.25 | 0.27 | 0.05 | — | 0.17 | 0.05 | 0.0003 | 0.005 | Balance |
| 4 | 61.76 | 1.38 | 0.26 | 0.06 | 0.33 | — | 0.03 | 0.0003 | — | Balance |
| 5 | 60.98 | 1.27 | 0.28 | 0.11 | 0.35 | 0.10 | 0.02 | 0.0012 | — | Balance |
| 6 | 58.89 | 1.49 | 0.26 | — | 0.31 | 0.20 | 0.02 | — | — | Balance |
| 7 | 60.21 | 1.35 | 0.24 | 0.02 | — | 0.17 | — | — | — | Balance |
| 8 | 60.40 | 1.60 | 0.27 | 0.04 | — | — | 0.01 | — | — | Balance |
| 9 | 60.40 | 2.11 | 0.21 | — | 0.06 | 0.10 | 0.02 | 0.0014 | — | Balance |

The lead-free brass alloy of present invention has been tested with results as follows:

1. Cuttability Test:

The samples for testing are in the half-hard state. The same cutting tool, cutting speed and feeding quantity (0.6 mm) is approached. The relative cutting ratio is calculated by testing cutting resistance of alloy C36000 and the invented alloy:

$$\frac{\text{Cutting resistance of alloy } C36000}{\text{Cutting resistance of the invented alloy}} \times 100\%$$

Figure 1:
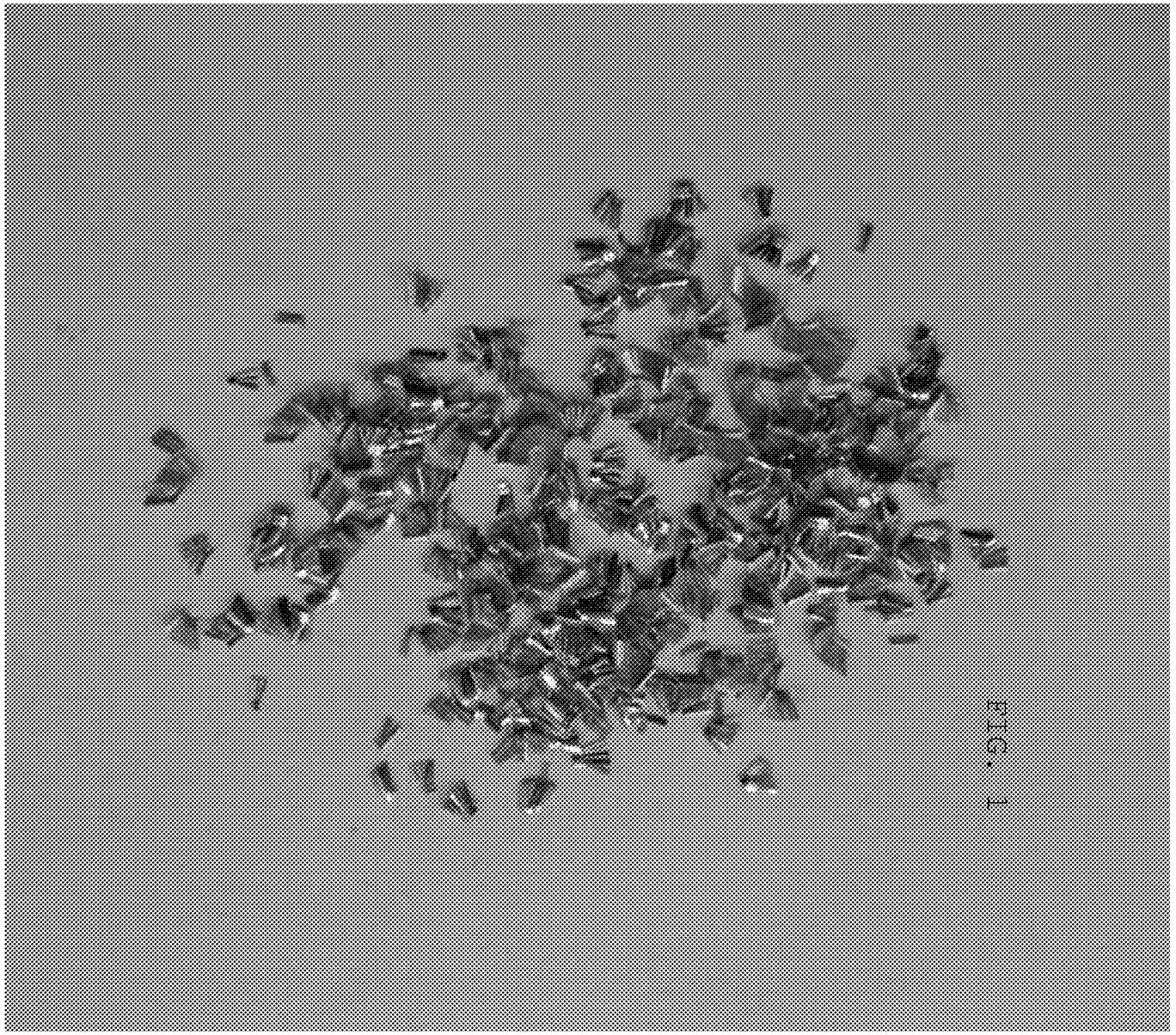
FIG. 1 shows the shapes of the cutting chips formed in Examples 1, 2 and 3.
Figure 2:
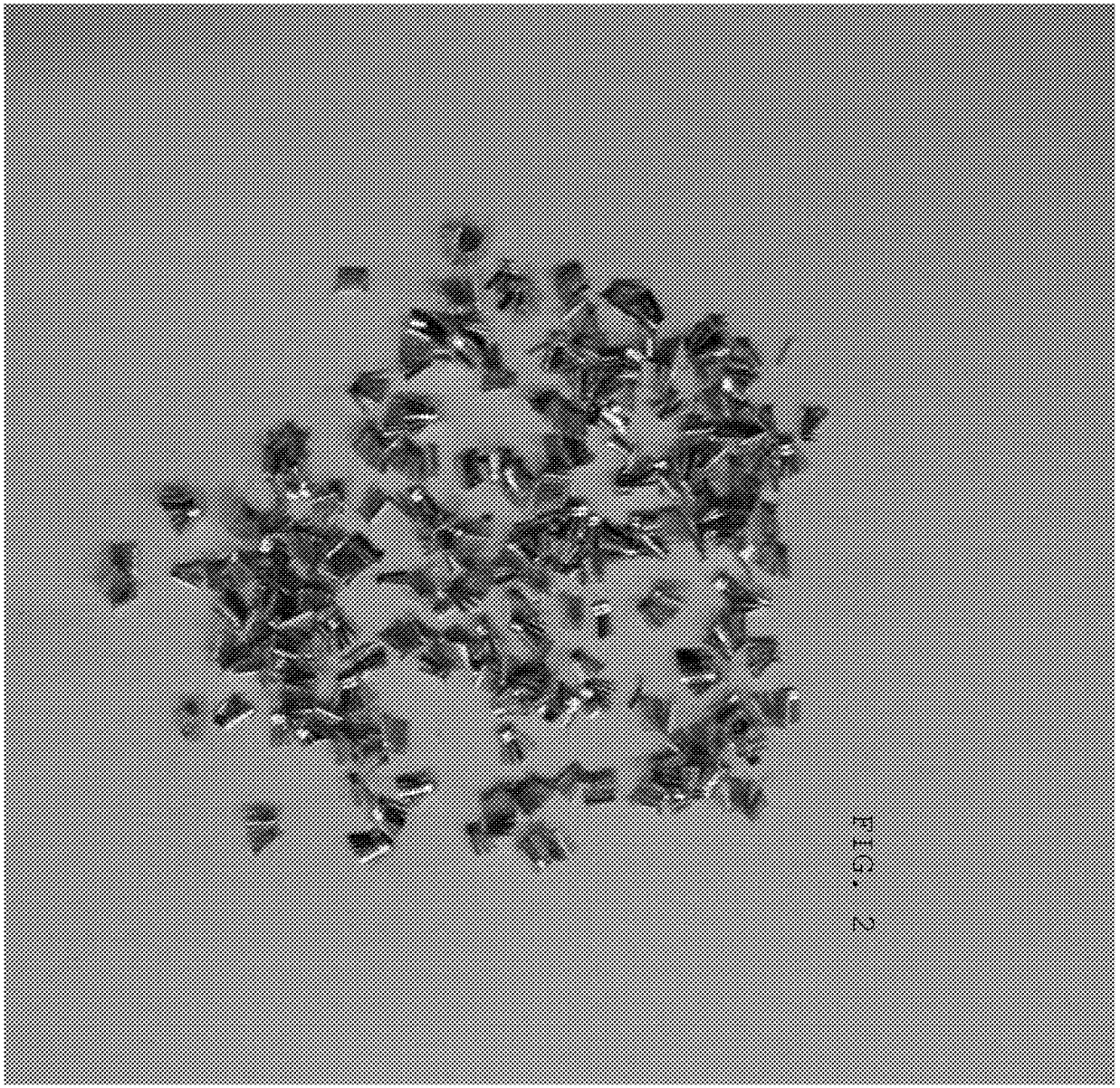
FIG. 2 shows the shapes of the cutting chips formed in Examples 4, 5 and 6.
Figure 3:
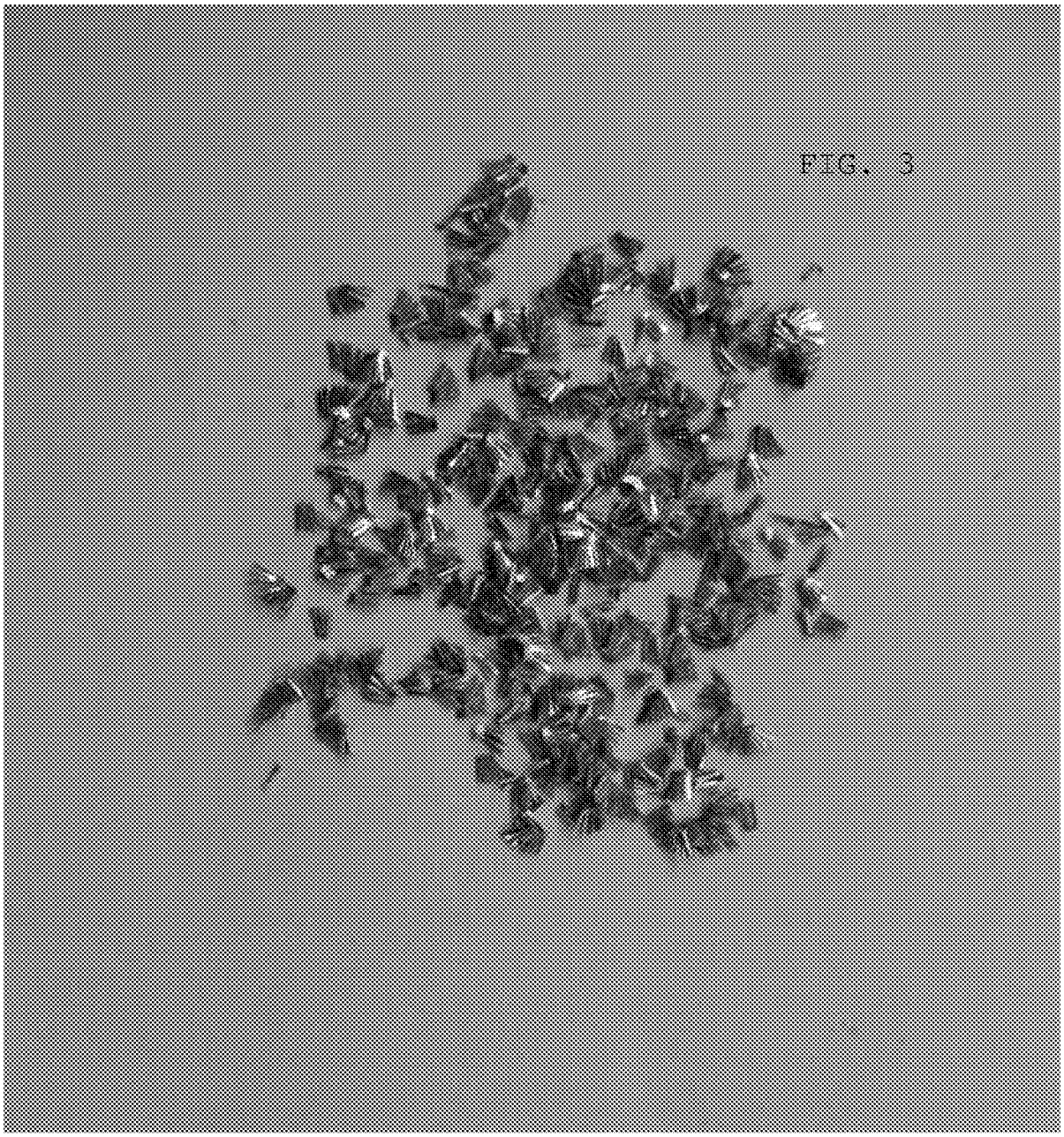
FIG. 3 shows the shapes of the cutting chips formed in Examples 7, 8 and 9.
Figure 4:
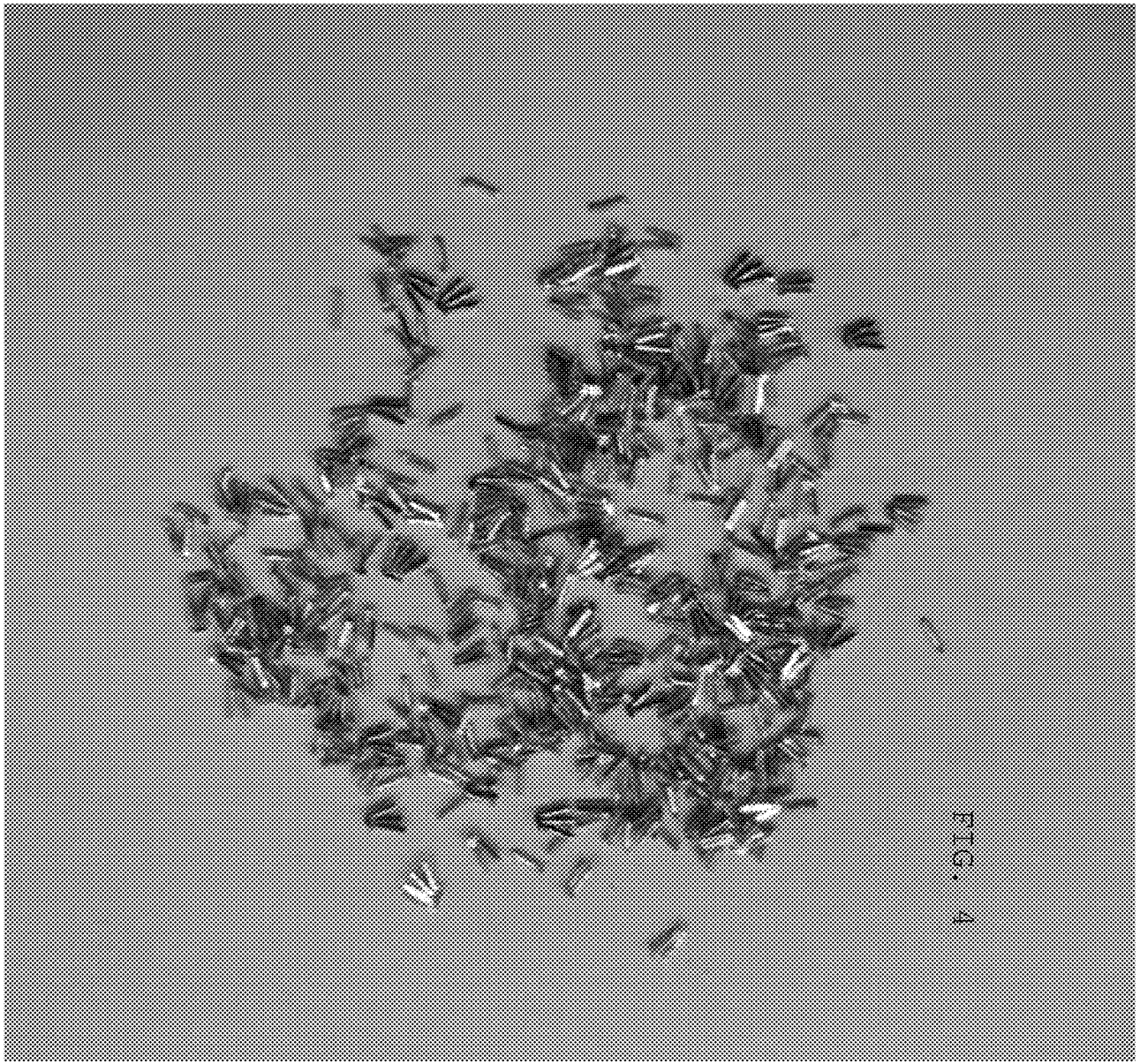
FIG. 4 shows the shapes of the cutting chips formed in cutting lead-contained brass alloy C36000 for comparison.

It's assumed that the cutting ratio of alloy C36000 is 100%. FIG. 4 shows the shapes of the cutting chips formed in cutting lead-containing brass C36000. Then the cutting ratio of examples 1, 2 and 3 is ≧80% by testing the cutting resistance of alloy C36000 and examples 1, 2 and 3 of the invented alloy. FIG. 1 shows the shapes of the cutting chips formed in Examples 1, 2 and 3. The cutting ratio of examples 4, 5 and 6 is ≧85% by testing the cutting resistance of alloy C36000 and examples 4, 5 and 6 of the invented alloy. FIG. 2 shows the shapes of the cutting chips formed in Examples 4, 5 and 6. The cutting ratio of examples 7, 8 and 9 is ≧90% by testing the cutting resistance of alloy C36000 and examples 7, 8 and 9 of the invented alloy. FIG. 3 shows the shapes of the cutting chips formed in Examples 7, 8 and 9.

Dezincification Corrosion Test:

The test for dezincification corrosion resistance is conducted according to the PRC national standard GB10119-88. The samples for testing are in the stress relief annealing state. The test result is shown in Table 2.

Stress Corrosion Test:

The sample for test is from extruded bar materials, casting and forging. The test for stress corrosion is conducted according to PRC national standard GB/T10567.2-1997, Ammonia fumigation test. The test result is satisfactory when no crack appears in the face of the samples.

Mechanical Properties Test:

The sample for testing are in half-hard state. The specification is Φ6 mm bar. The test results are shown in table 2.

Castability Test:

Several indexes can be used to measure the castability of the alloy. The test for conventional volume shrinkage and spiral simples is for measuring the flowability of the alloy. The test for cylindrical samples is for measuring shrinkage crack resistance of the alloy. The test for strip samples is for measuring linear shrinkage rate of the alloy. For volume shrinkage samples, as may be seen in Table 2, if the face of the concentrating shrinkage cavity is smooth, and no visible shrinkage porosity in the bottom of the concentrating shrinkage cavity, it indicates castability is excellent and will be shown as "o" in Table 2. If the face of the concentrating shrinkage cavity is smooth but the height of visible shrinkage porosity in the bottom of the concentrating shrinkage cavity is less than 5 mm, it indicates castability is good, and will be shown as "Δ" in Table 2. If the face of the concentrating shrinkage cavity is not smooth and the height of visible shrinkage porosity in the bottom of the concentrating shrinkage cavity is more than 5 mm, it indicates castability is poor, and will be shown as "x" in Table 2. For strip samples, the linear shrinkage rate is not more than 1.5%. For cylindrical samples, as may be seen in Table 2, if no visible shrinkage crack is shown, it indicates castability is excellent and will be shown as "o" in Table 2. If the visible shrinkage crack is shown, it indicates the castability is poor, and will be shown as "x" in Table 2. Spiral samples are for measuring the flowability of the invented alloy. The test results of castability are shown in Table 2. The above results indicate the castability of the alloy is fine.

TABLE 2

Dezincification corrosion, mechanical properties and castability of the invented alloy

| | | Examples | | | | | | | | | |
|---|---|---|---|---|---|---|---|---|---|---|---|
| | | 1 | 2 | 3 | 4 | 5 | 6 | 7 | 8 | 9 | C36000 |
| Dezincification layer thickness/μm | | 280 | 300 | 330 | 360 | 350 | 345 | 350 | 370 | 400 | 610 |
| Mechanical Properties | Tensile strength/MPa | 495 | 500 | 490 | 520 | 510 | 500 | 510 | 510 | 520 | 485 |
| | 0.2% Yield strength/MPa | 350 | 365 | 355 | 370 | 360 | 375 | 380 | 375 | 370 | 340 |
| | Elongation/% | 14 | 17 | 15 | 16 | 17 | 12 | 14 | 12 | 11 | 9 |
| Castability | Concentrating shrinkage cavity | ○ | ○ | ○ | ○ | ○ | ○ | ○ | ○ | | ○ |
| | Shrinkage crack | ○ | ○ | ○ | ○ | ○ | ○ | ○ | ○ | ○ | ○ |
| | Melt fluid length/mm | 470 | 475 | 465 | 460 | 465 | 470 | 480 | 485 | 490 | 470 |
| | Linear shrinkage rate/% | | | | | 1.4~1.8 | | | | | 1.95~2.15 |

What is claimed is:

1. A tin-free lead-free free-cutting magnesium brass alloy consisting of: 56.0 to 64.0 wt % Cu, 1.25 to 2.1 wt % Mg, 0.21 to 0.4 wt % P, and other elements 0.002 to 0.9 wt % which comprise at least two elements selected from the group consisting of Al, Si, Sb, rare earth elements, Ti and B and the balance being Zn with unavoidable impurities, and wherein an intermetallic compound is formed and a cutting percentage of said alloy is at least 80%.

2. The tin-free lead-free free-cutting magnesium brass alloy of claim 1 wherein the content of P is between 0.21 to 0.3 wt %.

3. The tin-free lead-free free-cutting magnesium brass alloy of claim 2 wherein the content of P is between 0.21 to 0.29 wt %.

4. The tin-free lead-free free-cutting magnesium brass alloy of claim 1 wherein the content of Mg is between 1.2 to 2.0 wt %.

5. The tin-free lead-free free-cutting magnesium brass alloy of claim 4 wherein the content of Mg is between 1.2 to 1.6 wt %.

6. The tin-free lead-free free cutting magnesium brass alloy of claim 1 wherein the content of Mg is between 1.6 to about 2.1 wt %.

7. The tin-free lead-free free-cutting magnesium brass alloy of claim 6 wherein other elements are selected from Ti and B.

8. The tin-free lead-free free-cutting magnesium brass alloy of claim 1 wherein the content of other elements is between 0.003 to 0.8 wt %.

9. The tin-free lead-free free-cutting magnesium brass alloy of claim 8 wherein the content of other elements is between 0.003 to 0.05 wt %.

10. The tin-free lead-free free-cutting magnesium brass alloy of claim 1 wherein the cutting ratio percentage of said alloy is at least 85%.

11. The tin-free lead-free free-cutting magnesium brass alloy of claim 1 wherein the cutting ratio percentage of said alloy is at least 90%.

12. A tin-free lead-free free-cutting magnesium brass alloy consisting of: 56.0 to 64.0 wt % Cu, 1.25 to 2.5 wt % Mg, 0.21 to 0.4 wt % P, and other elements 0.002 to 0.9 wt % which comprise at least two elements selected from the group consisting of Al, Si, Sb, rare earth elements, Ti and B and the balance being Zn with unavoidable impurities, and wherein an intermetallic compound is formed and a cutting percentage of said alloy is at least 80%.

13. A tin-free lead-free free-cutting magnesium brass alloy consisting of: 56.0 to 64.0 wt % Cu, and 1.25 to 2.5 wt % Mg, 0.21 to 0.4 wt % P, Ni in an amount of less than 0.01 wt % and other elements 0.002 to 0.9 wt % which comprise at least two elements selected from the group consisting of Al, Si, Sb, rare earth elements, Ti and B and the balance being Zn with unavoidable impurities, and wherein an intermetallic compound is formed and a cutting percentage of said alloy is at least 80%.

* * * * *